United States Patent [19]

Deconinck

[11] 4,177,901

[45] Dec. 11, 1979

[54] BATHROOM WALL FIXTURE

[75] Inventor: Didier Deconinck, Seyssins, France

[73] Assignee: Allibert Exploitation, Grenoble, France

[21] Appl. No.: 897,423

[22] Filed: Apr. 18, 1978

[30] Foreign Application Priority Data

Apr. 19, 1977 [FR] France ..... 77 12642

[51] Int. Cl.[2] ..... F16M 13/00

[52] U.S. Cl. ..... 211/105.1; 248/251; 248/475 R

[58] Field of Search ..... 211/105.1; 248/214, 248/215, 251, 475 R, 488, 490

[56] References Cited

U.S. PATENT DOCUMENTS 3,252,236 5/1966 Davis ..... 248/475 R

FOREIGN PATENT DOCUMENTS 713438 7/1965 Canada ..... 248/475 R
698863 11/1930 France ..... 248/475 R
908935 10/1962 United Kingdom ..... 248/251
1213270 11/1970 United Kingdom ..... 211/105.1

*Primary Examiner*—William H. Schultz
*Attorney, Agent, or Firm*—Karl F. Ross

[57] ABSTRACT

A bathroom wall fixture has a mirror whose lower edge is secured in a pair of like supports each having a seat engaging and supporting the mirror. These supports each have an upper part and a lower part and together form the seat for the mirror and are formed with respective holding formations between which a horizontally extending bar may be clamped by screws vertically engageable between the upper and lower parts of these supports. Accessories such as shelves or the like can be fitted over the bar and positioned anywhere therealong, and this bar can project to either side of the supports for use as a towel rack.

10 Claims, 3 Drawing Figures

BATHROOM WALL FIXTURE

FIELD OF THE INVENTION

The present invention relates to a wall fixture. More particularly this invention concerns a wall fixture particularly adapted for use in a bathroom.

BACKGROUND OF THE INVENTION

A bathroom is typically provided over the sink with a mirror over which in turn is provided a lamp and under which are provided several fixtures such as a toothbrush holder, a soap stand, a glass holder, and the like. At one time it was standard practice for all of these units to be separate, but it is now customary to use a one-piece mirror-and-lamp assembly. Nonetheless the other fixtures such as the towel bar, soap rack, and the like must still be separately mounted under or next to the mirror. Once the positioning of these various fixtures is decided on, they are normally permanently affixed to the wall.

Such an arrangement has the considerable disadvantage that if the owner or user subsequently decides that the positioning or layout is unsatisfactory, it is only possible with considerable difficulty to change such positioning or layout, normally by ripping out the installed fixtures and re-installing them in the desired positions. Furthermore the initial installation of such fixtures normally is a bothersome task that can only be carried out by expert and trained installers.

OBJECTS OF THE INVENTION

It is therefore an object of the present invention to provide an improved wall fixture.

Another object of this invention is to provide an improved wall fixture particularly adapted for bathroom use.

A further object is to provide a wall fixture which overcomes the above-given disadvantages.

SUMMARY OF THE INVENTION

These objects are attained according to the present invention in a wall fixture usable in a bathroom and having a pair of horizontally spaced supports securable to a wall and serving as the lower mounts for the mirror. A bar is releasably held between these two supports and in turn shelves, hooks, holders and the like can be slidably and releasably mounted on this bar which extends horizontally between and beyond these two supports.

Thus the system according to the instant makes it merely necessary to mount the two supports on the wall, with the mirror supported on them and the bar extending between them. Thereafter whatever individual fixtures the user desires to employ can be placed on the bar in any desired location therealong, and this placement can be changed at any time with ease.

According to further features of this invention each of the holders comprises an upper part formed with a downwardly directed and laterally open holding formation and a lower part formed with an upwardly directed and laterally open holding formation. Means normally in the form of a screw engaged vertically between these two parts allows the two formations to be pulled toward each other to clamp the bar between them. In addition the upper part and lower part together form an upwardly open seat for the lower edge of the mirror so that when the two parts are assembled the mirror is also held securely in place.

According to this invention the lower part, which forms the back side and the bottom surface of the seat for the mirror, is secured to the wall by means of a screw passing through a hole in this lower part. The mirror is then positioned on the lower part and the bar is rested in place. Thereafter both upper parts are placed on the respective lower parts and are clamped in place by the respective screws to hold the mirror and bar in place. In this manner extremely rapid and easy assembly is possible. The hole through the lower part is made relatively wide so as to permit vertical and even lateral positioning within a limited range of the lower part before securing it to the wall.

The supports may be made of synthetic-resin material so that they have a long service life in the moist conditions under which the fixture is normally employed. The shelf member, which may be a soap holder, a glass holder, a hook, or a simple shelf, is similarly formed of synthetic-resin material. The bar may be constituted of wood for decorative effect, or may be a metal or synthetic-resin bar.

According to further features of this invention the shelf member is formed with a downwardly open recess or hook that is engaged over and complementary to the upper edge of the bar. Thus the shelf can easily be removed from or moved along the bar. Furthermore according to this invention the bar may extend laterally well to one side or the other of the two supports, so that the projecting end of the bar can be used as a towel rack, or a support for further shelves. As the holding formations, which are formed as upwardly and downwardly open part-cylindrical grooves, are laterally open there is no obstruction for the bar which can therefore project laterally to either side.

Although in the discussion above reference is frequently made to the invention as being a bathroom fixture, there is no intent to limit the invention thereto, even though the fixture does have particular utility in a bathroom. Thus the bathroom fixture according to this invention could easily be used in any other type of room, as for example a dressing room, cloakroom, or even as a hall mirror.

SPECIFIC DESCRIPTION

Figure 1:
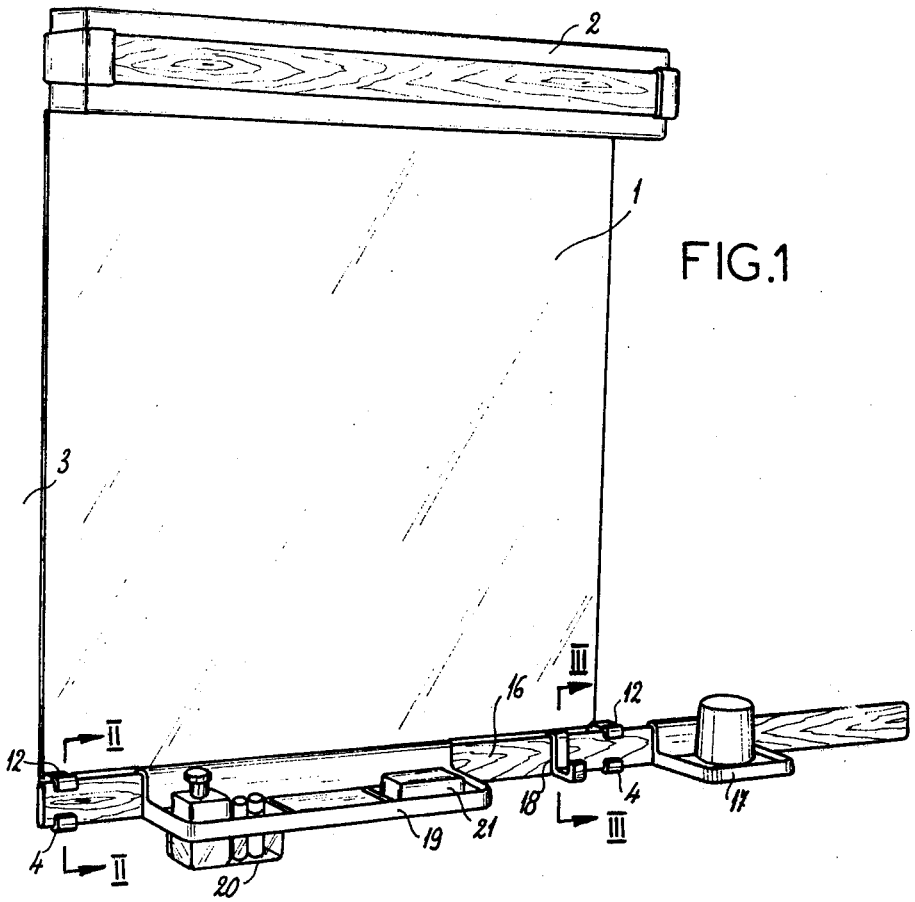
FIG. 1 is a perspective view of the instant invention.

As shown in FIG. 1 the fixture according to this invention basically comprises a rectangular and upright planar mirror 1 surmounted by a horizontally extending light fixture or lamp 2 and secured to a wall 3. The mirror is supported at its lower edge at each corner on a support 4. A horizontally extending wooden bar 16 is held in two supports 4 and extends laterally to one side well past the right-hand support of FIG. 1. A cup holder 17, coat hook 18, and shelf 19 having a well 20 for bottles and a support for soap 21 are provided on this bar 16.

Figure 2:
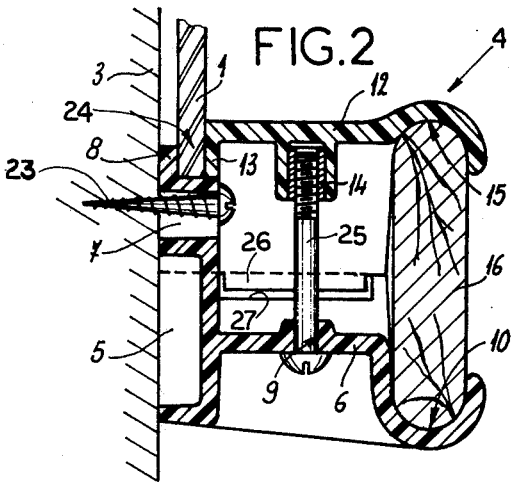
FIGS. 2 and 3 are sections taken along lines II—II and III—III of FIG. 1, respectively.
Figure 3:
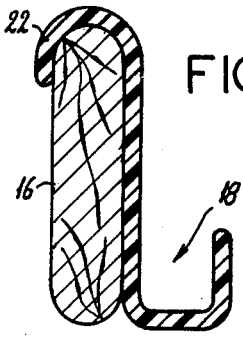

As shown in more detail in FIG. 2, each of the identical supports 4 is formed as a lower part 6 having a base 5 formed in turn with a relatively wide hole 7 secured by a screw 23 to the wall 3. This base 5 has an upwardly extending flange 8 that forms the rear side of a seat 24 for the lower edge of the mirror 1. In addition the lower part 6 is formed with a part-cylindrical upwardly open holding formation or channel 10 that snugly engages the complementarily shaped lower edge of the rail 16. The holder 4 also comprises an upper part 12 having a downwardly extending flange 13 forming the front side of seat 24 for the lower edge of the mirror 1 and also forms the part-cylindrical downwardly open channel or groove 15 engaging the complementarily shaped upper edge of the rail 16. This upper part 12 is provided with a metallic sleeve 14 into which the threaded end of a screw 25 passing through a hole 9 in the web part 6 passes. A tongue 26 and groove 27 respectively in the upper part 12 and the lower part 6 ensure proper vertical alignment of these two parts.

In use the two lower parts 6 are secured approximately in the proper positions by screws 23. A level is used to assure exact positioning of these lower parts 6 and the screws 23 are tightened when such positioning has been obtained. Thereafter the lower edge of the mirror 1 is seated on the lower parts 6 against the rear flange 8 thereof. The lower edge of bar 16 is then seated in the upwardly concave formations 10 of both supports 4.

Thereafter each of the upper parts 12 is fitted over the bar 16 and with its flange 13 pressed against the front of the mirror 1. The screws 25 are then fitted in and tightened to hold the entire assembly snugly together with the bars 16 tightly gripped between the upper and lower formations 15 and 10.

Subsequently the various shelf accessories 17 and 19 and the hook 18 can be mounted in any location along the bar 16. Furthermore the bar 16, which can project to either side of the mirror 1, can readily serve as a towel bar or washcloth holder. The various accessories can be slid along the bar 16 or moved about at will.

Thus the system according to the instant invention makes it very easy to mount the entire fixture. The mirror and the bar are both held in place simply by putting together the upper and lower parts of the supports 2 which themselves can easily be secured to and positioned on the wall 3. After installation it is possible to arrange the accessories in any desired manner, and it is a very simple matter to remove the mirror 1 if desired.

I claim:

1. A bathroom wall fixture comprising:

a mirror;

a pair of like supports each having a seat engaging and supporting said mirror;

a generally horizontally extending bar carried on said supports and horizontally and longitudinally displaceable thereon with respect to said mirror;

means on each of said supports tightenable for securing same to said bar and thereby fixedly positioning said bar relative to said mirror; and at least one shelf acccessory supported on and horizontally slidable along said bar.

2. The fixture defined in claim 1 wherein said seats are each an upwardly open groove, said mirror having a lower edge engaged in said grooves.

3. A bathroom wall fixture comprising:

a mirror having a lower edge;

a pair of like supports each having a seat formed as an upwardly open groove in which said lower edge is engaged to support said mirror, each support having an upper part having a downwardly directed holding formation and a lower part having an upwardly open holding formation;

a generally horizontal bar;

means on each of said supports including at least one clamping element on each of said supports for displacing said formations toward each other and clamping said bar between said formations for securing said supports to said bar and thereby fixedly positioning said bar relative to said mirror; and at least one shelf accessory supported on and horizontally slidable along said bar.

4. The fixture defined in claim 3 wherein said clamping elements are each at least one screw threadedly engaged between the parts of the respective support.

5. The fixture defined in claim 3 wherein said lower parts are each provided with means for securing themselves to a wall.

6. The fixture defined in claim 5 wherein said means for securing each include a screw and a hole through the respective lower part.

7. The fixture defined in claim 3 wherein said downwardly directed formation is laterally horizontally open and downwardly concave and said upwardly open formation is laterally horizontally open and upwardly concave, said bar extending laterally past and through both of said supports.

8. The fixture defined in claim 3 wherein said shelf accessory is formed with a downwardly open groove complementary to the upper edge of said bar.

9. The fixture defined in claim 3 wherein said seats each have a base surface, one side formed by the respective lower part, and another side formed by the respective upper part.

10. The fixture defined in claim 3 wherein said supports are made of synthetic-resin material.

* * * * *